United States Patent [19]

McKelvie

[11] 4,384,535

[45] May 24, 1983

[54] SOLID FUEL BURNING FURNACE

[76] Inventor: Alastair H. McKelvie, Derry Gally Rd., Kinnelon, N.J. 07405

[21] Appl. No.: 311,468

[22] Filed: Oct. 14, 1981

[51] Int. Cl.[3] ..... F23J 1/00

[52] U.S. Cl. ..... 110/165 R; 126/170; 126/242; 198/757

[58] Field of Search ..... 110/101 CD, 165, 169, 110/259, 277, 298, 299, 300; 126/153, 154, 170, 242; 222/199; 198/756, 757, 764

[56] References Cited

U.S. PATENT DOCUMENTS

| | | | |
|---|---|---|---|
| 1,945,782 | 5/1930 | Jones . | |
| 2,050,747 | 1/1932 | Corbett . | |
| 2,637,437 | 5/1953 | Jacobsen | 198/757 |
| 2,654,466 | 12/1950 | Spurlin . | |
| 2,662,192 | 3/1951 | Weyandt . | |
| 2,758,704 | 2/1953 | Spurlin . | |
| 2,832,464 | 8/1953 | Smith . | |
| 3,208,580 | 9/1961 | Baruch . | |
| 3,530,974 | 4/1968 | Moore . | |
| 3,746,211 | 7/1973 | Burgess, Jr. . | |
| 3,915,292 | 10/1975 | Brown . | |
| 4,181,216 | 1/1980 | Cipu | 198/757 |
| 4,195,447 | 4/1980 | Walther et al. . | |

OTHER PUBLICATIONS

Amer. Soc. of Heating and Refrigeration Application Engineers, *Equipment Handbook*, 1979, pp. 23.10–23.13.

*Primary Examiner*—Edward G. Favors
*Assistant Examiner*—Steven E. Warner
*Attorney, Agent, or Firm*—Barry Evans

[57] ABSTRACT

A solid fuel furnace includes a vibratory bowl for its fuel bed. Structure in the furnace defines a fuel chamber over the central part of the bowl and a combustion chamber over the outward part of the bowl. Fuel is distributed outward by a central cone on the bowl. Primary air is fed beneath the rim of the cone into the fuel in the combustion chamber. The vibratory motion keeps the fuel particles evenly distributed and prevents blowholes from developing, leading to improved combustion. The vibratory motion also marches ash particles up a spiral groove in the circumferential wall of the bowl to facilitate ash removal from the fuel bed.

17 Claims, 3 Drawing Figures

SOLID FUEL BURNING FURNACE

BACKGROUND OF THE INVENTION

1. Field of the Invention

This invention relates to solid-fuel-burning heat generating apparatus, and is particularly directed to a solid fuel burning furnace having a vibratory bed for the fuel.

2. Description of the Prior Art

Solid fuel stoves and furnaces have been proposed in which the fuel is introduced therein, for example, on a chain grate. This facilitates automatic stoking and ash or cinder removal, but cannot guarantee complete and efficient combustion. In order to enhance combustibility, forced air is introduced into the bed of solid fuel in the furnace to circulate and provide sufficient oxygen to the burning coals of solid fuel. However, the fuel, as it burns, can become rather compacted, and normally a great deal of pressure is required to ensure adequate air circulation. Even then, the forced air tends to take the path of least resistance through the fuel bed. Consequently, so-called blow holes develop which form channels for the forced air, and the air ceases to reach more compacted masses of fuel apart from the blow holes. Further, the forced air passes more quickly through the blow holes and tends to cool the burning coals, thereby keeping the heating system below maximum heating efficiency.

Additionally ash removal systems tend to be rather complex and inefficient, and their presence further interferes with the efficient combustion of the solid fuel.

Furthermore, conventional solid fuel heating apparatus, such as wood stoves or coal furnaces, tend to burn dirty, emit considerable smoke, and require frequent cleaning. Such apparatus cannot burn a wide range of fuel types and sizes, and do not operate well if the fuel is wet.

OBJECTS AND SUMMARY OF THE INVENTION

Accordingly, it is an object of this invention to provide a solid-fuel burning heating apparatus that overcomes the above defects of conventional stoves and furnaces.

It is another object of this invention to provide solid-fuel burning heating apparatus which achieves even burning of the fuel while avoiding "blow holes" in the fuel bed and lowering the air pressure required for the injected forced air.

It is yet another object of this invention to provide a solid-fuel-burning furnace in which the bed of fuel is maintained in a more-or-less "fluidized" state, so that air can surround each particle of fuel, yielding even, improved combustion.

It is still another object of this invention to provide solid fuel burning heating apparatus in which ash removal is simplified and in which fires are readily combusted.

It is a further object of this invention to provide solid fuel burning heating apparatus which is capable of being fed wet fuel, and which then dries the wet fuel and combusts the same efficiently.

It is a still further object of this invention to provide solid fuel burning heating apparatus in which secondary fuels (i.e., gas or oil) can be used without any design changes.

In accordance with an aspect of this invention heating apparatus are provided for use in burning solid fuel, which, after combustion, leaves an ash residue. The apparatus includes a fuel chamber, a combustion chamber, a mechanism for introducing solid fuel into the fuel chamber, a primary air jet for introducing air into the combustion chamber, an exhaust flue for venting exhaust from the combustion chamber, and a fuel bed extending from the fuel chamber into the combustion chamber. An improved feature of this apparatus is that the bed includes a vibratory bowl having a generally circular base and a helically-grooved side wall with a groove therein extending around the wall from substantially the bottom to a top edge of the wall. A vibratory drive imparts a torsional vibration to the bowl so that ash produced by combustion is urged up the groove and out of the bowl, and is then conducted to an ash can or other container.

The vibrational motion, preferably related to the line-frequency rate (i.e. 60 Hz) keeps the coals and other fuel particles in motion as the forced air passes through the fuel. Thus, the solid fuel particles remain in a more-or-less fluidized state and are all bathed in the primary air, leading to even, clean combustion, even at a reduced air pressure.

The above and other objects, features, and advantages of this invention will become apparent from the ensuing detailed description of one preferred embodiment thereof, when read in conjunction with the accompanying drawings.

DETAILED DESCRIPTION OF A PREFERRED EMBODIMENT

Figure 1:
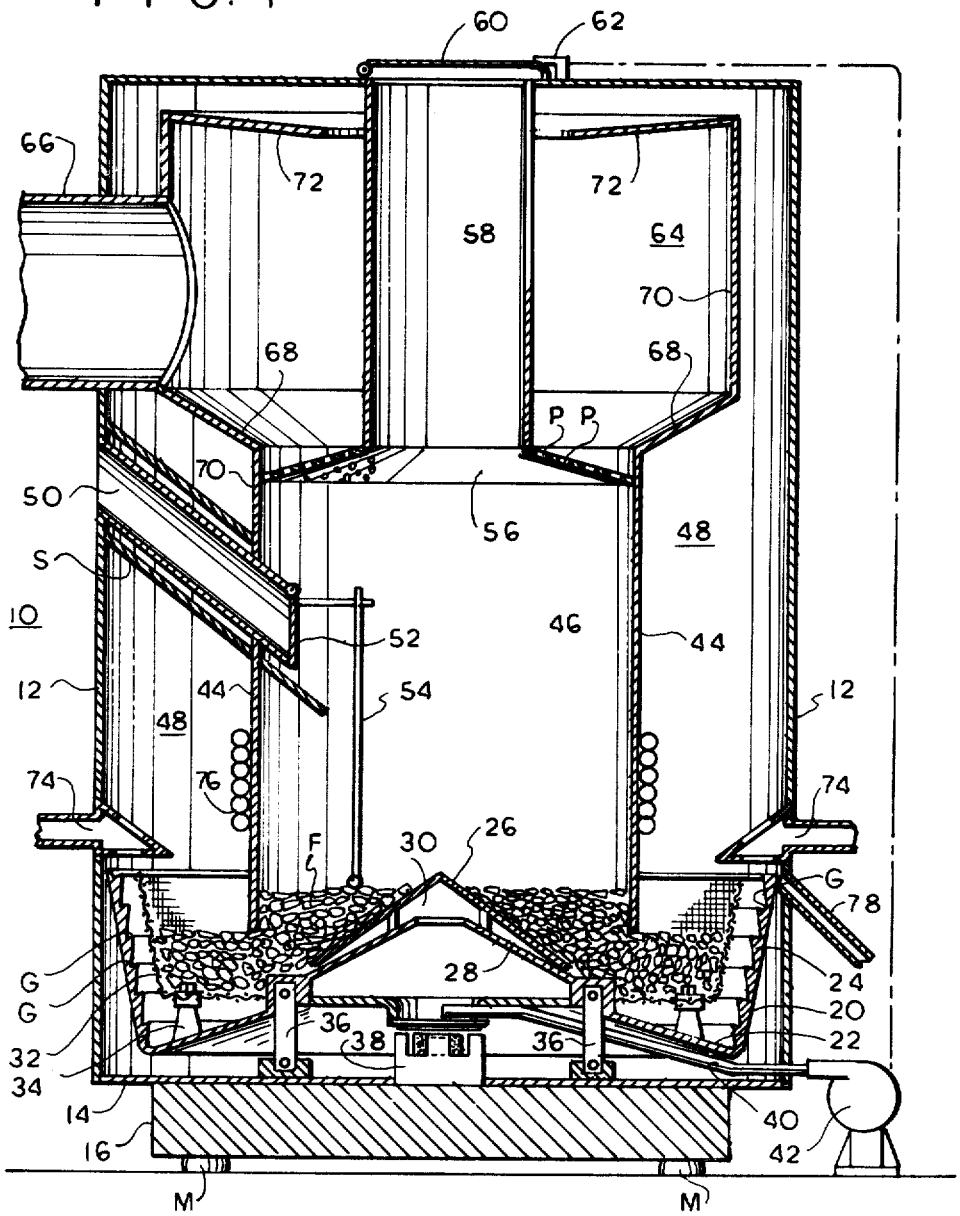
FIG. 1 is a sectional elevation of an embodiment of a furnace according to this invention.

Referring initially to FIG. 1, one exemplary furnace 10 embodying this invention has an outer wall 12, which can be lined with refractory material, forming generally a housing for the furnace 10. A floor 14 thereof is mounted on a base 16 of inertial material, which rests on three or more mounts M of elastomeric material.

Figure 2:
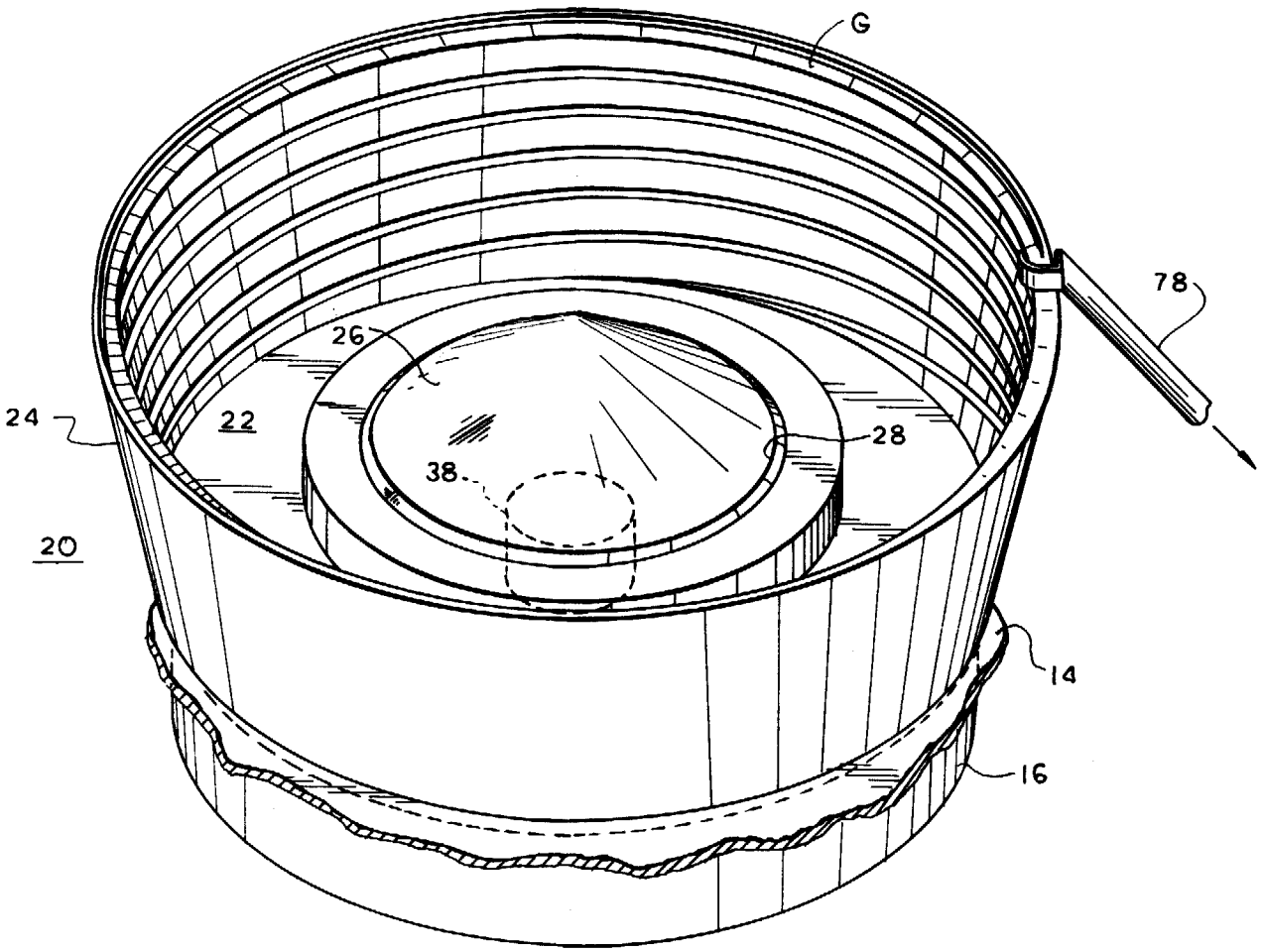
FIG. 2 is a perspective view of a portion of the furnace of FIG. 1.

Mounted centrally on the furnace floor 14 is a vibratory bowl 20 having a substantially circular floor 22 and an upstanding circumferential wall 24. As better seen in the perspective view of FIG. 2, this bowl 20 has a spiral groove G therein. In this embodiment a single helical groove G extends from the bottom to the top of the wall 24, although in other embodiments two or more such spiral grooves could be used.

The groove G is used to carry ash A upward by vibratory motion, and so the groove G should have a pitch less than the angle of repose of the particles of ash A.

Disposed centrally on the floor 22 of the bowl 20 is a central cone 26 with an apexless inner cone 28 disposed coaxially therebeneath. The cones 26 and 28 are separated from each other somewhat and define a primary air passageway 30 therebetween. As will be seen later, air is preheated in the passageway 30 and also absorbs heat from the floor 22 of the bowl 20, thereby cooling it, before being ejected beneath the margin of the cone 26.

Figure 3:
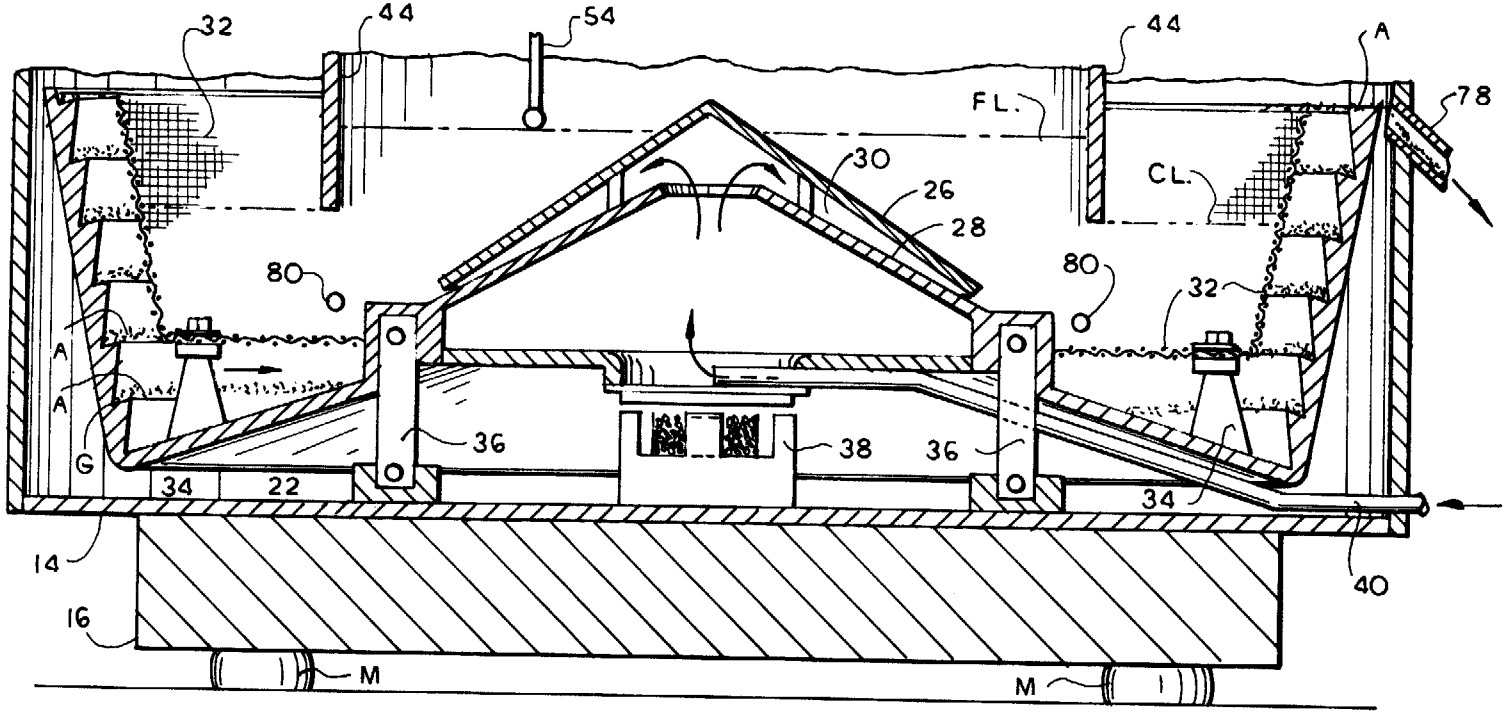
FIG. 3 is a sectional elevation of a portion of the furnace of FIG. 1.

As is perhaps better shown in FIG. 3, a screen 32 is provided as supporting web for particles of solid fuel F.

The mesh of the screen 32 is selected to be smaller than the size of the burning coals of fuel F, but larger than the expected size of particles of ash A. Support posts 34 mounted around the floor 22 of the bowl 20 support the screen 32 above the floor 22, which slopes downwardly towards the wall 24. The arrangement including the screen 32 ensure that ash A is carried out from beneath the bed of fuel F up the groove G.

The support posts 34 are joined at the level shown in ghost lines thereon to form a dam for the ash A, thereby causing a layer of the ash A to accumulate beneath the burning coals. This layer insulates the floor 22 from extreme heat of combustion.

A vibratory drive for the furnace 10 includes a set of mounting springs 36 and a vibratory drive motor 38 having an armature disposed on the furnace floor 14 and a movable member centrally disposed on the bottom side of the floor 22 of the bowl 20. The armature thereof is fed with half-wave rectified line current, and causes the bowl 20 to be pulled intermittently downward and then released. The mounting springs 36, which are canted somewhat and mounted at points on the bowl 20, cause the bowl 20 to rotate slightly when it is drawn down, and then impart a twisting thrust thereto when the motor 38 releases the bowl 20. Thus, the particles of ash A are vibrated clockwise, and move up the groove G to the top of the wall 24.

The furnace 10 also includes a primary air duct 40 extending to the center of the bowl 20 at a point within the cone 28. Forced primary air is then supplied through the duct 40, upward through the cone 28 into the air passageway 30 and thence under the rim of the cone 26. A blower 42 supplies the forced primary air to the duct 40.

The furnace 10 also includes a fuel magazine, here constructed as a cylindrical wall 44 disposed concentrically with the bowl 20 and within the wall 12. The magazine wall 44 defines a fuel chamber 46, (i.e., the cylindrical core therewithin) and a combustion chamber 48 (i.e., the annulus between the walls 12 and 44).

The lower edge of the magazine wall 44 is disposed below the top of the wall 24 but above the floor 22 of the bowl 20, and defines a combustion level CL of the fuel F in the combustion chamber. A corresponding fuel level FL of the fuel in the fuel chamber 48, disposed above the level CL, is determined in a manner described below.

A fuel feed chute 50 extends through the walls 12 and 44 into the interior of the fuel chamber 46. A door 52 closes off the magazine end of the chute 50, and a fuel-level sensor rod 54 is affixed to the door 52. A shield S surrounds the chute 50 to prevent fuel therein from being heated to the combustion point.

Fuel is furnished, for example from an Archimedian screw (not shown), to the chute 50. A switch (not shown), on the door 52 normally closes when the door 52 swings completely closed. The Archimedian screw is operated intermittently for several seconds at a time. The fuel F then proceeds down the chute 50, opening the door 52 and lifting the rod 54. When the fuel F stops, the door 52 is free to close. As long as the actual fuel level is below the level FL, the rod 54 will drop below the level FL and the door 52 will close completely and the switch closes. However, when the new fuel F causes the level FL to be met or exceeded, the rod 54 will drop down only to the top of the fuel, above the level FL, and although the door 52 will be completely closed, the switch will remain open, and the periodic cycling of the Archimedian screw is stopped. Thus, the fresh fuel level is kept substantially at the level FL. Once the level of the fuel F is drawn down below the level FL, the door 52 will close completely, and the feed cycle will begin again.

The magazine also includes a top 56 with perforations P therein. These perforations P permit moisture from the fuel F in the fuel chamber 46 to pass out thereof.

A maintenance access chute 58 extends upward from the center of the top 56, and is provided for enabling inspection and cleaning of the interior of the furnace 10. A door 60 is provided to close off the maintenance access chute 58. A safety interlock 62, coupled to the blower 42, ensures that the primary air will be furnished only if the door 60 is closed.

An exhaust chamber 64 is provided at the top of the furnace 10 and connects to an exhaust flue 66. A baffle 68 extends from the top of the magazine 44 radially outward toward the wall 12 to separate the combustion chamber 48 from the exhaust chamber 64. A vertical cylindrical collar 70 is disposed at the radially outward edge of the baffle 68 and another baffle 72 extends inward from the collar 70 toward the chute 58. The interior of the baffles 68, 72 and the collar 70 defines the exhaust chamber 68, while an annulus between the collar 70 and the wall 12 and the space between the baffle 72 and the top of the housing 10, cause cycloning of the combusting gasses and solid particles carried therewith. This spirals the flame path, and thereby lengthens it for more efficient combustion. The structure 68, 70, 72 also causes the gas velocity to drop at the position over the top 56 of the magazine 44, and any unburned solid particles remaining drop from the gas. These then pass through the perforations P and enter the fuel chamber 46 to be recycled.

Also included in the furnace are secondary air inlet jets 74 for introducing secondary air into the combustion chamber at a point above the fuel F.

Optional water heating coils 76 can be disposed, for example, on the outside of the magazine wall 44.

An ash conduit 78 is provided to carry the ash A from the end of the groove G to an ash canister (not shown) outside the furnace.

An electric heating element 80 can also be disposed inside the bowl 20, for example, encircling the rim of the cone 26, for initially igniting the fuel F, or for re-igniting the same if it should become extinguished.

In operation, the fuel F is introduced through the chute 50 into the fuel chamber 46. The fuel F is distributed outward by the cone 26 and is ignited by the element 80. Forced primary air is injected, from the conduit 40, through the air passageway 30 between the cones 26 and 28, into the fuel F in the combustion chamber 48. At this time the bowl 20 is vibrated, and the fuel F is vibrated along with it. This vibration keeps the fuel F in motion in the combustion chamber, so that by action of the primary air passing through it, the burning fuel becomes fluidized. The particles of fuel F burn evenly and completely, leaving the ash residue A. The problem of "blow holes" in the fuel bed is completely avoided. The ash residue A then falls through the screen 32 and is marched up the groove G to the ash conduit 78.

As the fuel F in the fuel chamber 48 is spent, the cone 26, which is also vibrated, urges the fresh fuel F in the fuel chamber 46 to move radially to the combustion chamber 48. Thus fresh fuel F is continuously supplied as the fuel F is used up, and the burning coals of the fuel F in the outer combustion chamber are not smothered by the fresh fuel, as in conventional apparatus.

The secondary air jets 74 ensure that the gasses above the bed of coals in the combustion chamber 48 are completely oxidized, thereby reducing the levels of CO as well as more efficiently combusting the fuel F. Fines of the fuel are also combusted more readily.

Further, the design of this invention permits the fuel F in the fuel chamber 46 to be preheated and dried, if necessary, so that the fuel F will burn more efficiently. With this invention moisture-laden fuel, such as green wood or garbage, can be burned without degrading the operation of the furnace. In the case of garbage, fumes emanating therefrom are burned by the exhaust gas passing over the perforated top 56.

Alternatively to the above described embodiment, a fuel inlet could be provided directly above the cone 26. Also air injection jets for the primary air could be disposed above or below the bed of fuel F.

The invention could also be practiced using other than spirally-grooved bowl 20 for ash removal. For example, a reciprocally vibrated bed could be used, having inclined stepped planes disposed thereon to carry ashes out of the furnace.

Jets for oil or natural gas can be included to supplement the solid fuel or to use an alternative fuel in place of it in times of short supply.

Vanes can be included above the fuel bed to reflect heat back and downward into the combustion chamber 48, thereby leading to improved burning efficiency.

Also, the location of the drive motor 38 is not critical, and other drive arrangements could be used. For example, a balanced two-motor drive system could be used, with the motors displaced away from the center of the bowl 20.

In addition, a sweeper blade can be used on the spiral groove G to ensure that particles larger than a predetermined size (i.e., unburned fuel) are returned to the fuel bed.

The invention is certainly not confined to the embodiment defined in detail above, and various modifications and variations thereof would be apparent to persons of ordinary skill without departure from the scope and spirit of this invention as defined in the appended claims.

I claim:

1. In heating apparatus for use in burning solid fuel of the type which after combustion leaves an ash residue and comprising a fuel chamber, a combustion chamber, means for introducing solid fuel into the fuel chamber, means for introducing air into the combustion chamber, exhaust means for venting exhaust gas from the combustion chamber, and a bed extending from said fuel chamber into said combustion chamber; the improvement wherein said bed includes a vibratory bowl having a generally circular bottom, and a helically-grooved side wall with a groove therein extending substantially from said bottom to a top edge of said wall; vibratory drive means for driving said bowl so that the ash residue resulting from said combustion is urged by vibration up said groove to the top edge of the bowl side wall; and said apparatus further includes means for conducting away from said furnace said ash that is driven to said top edge.

2. Heating apparatus as in claim 1, further comprising a cylindrical wall concentric with said vibratory bowl and having a lesser diameter than the latter, so that the interior of the cylindrical wall defines said fuel chamber and the exterior thereof defines said combustion chamber.

3. Heating apparatus as in claim 2, further comprising means cooperating with the top of said cylindrical wall substantially to close off said fuel chamber from said combustion chamber.

4. Heating apparatus as in claim 3, wherein said means cooperating with said cylindrical wall is perforated to permit vapors from fresh fuel in said fuel chamber to escape to said exhaust means, thereby permitting said fresh fuel to be pre-dried before being conveyed in said bowl to the combustion chamber.

5. A solid fuel burning furnace comprising a housing having a base and an exterior wall; a vibratory bed disposed at said base and having a bottom and an upstanding wall, said upstanding wall having a track disposed therein for vibratorily transporting ash residue from said fuel out of said bed; drive means for imparting a vibratory motion to said bed; fuel chamber means within said housing and having a lower position thereof defined by one portion of said bed, an interior wall extending upwardly from the bed, and a top; combustion chamber means defined by a remaining portion of said bed beyond said interior wall, and contained in a portion of said furnace thereabove between said interior wall and said exterior wall, means for introducing fuel into said fuel chamber means; means for injecting air into said combustion chamber means; flue means for venting exhaust gases from said combustion chamber means; and means coupled with said track of the vibratory bed for receiving said ash residue.

6. A solid fuel burning furnace according to claim 5, wherein said vibratory bed includes a bowl, said upstanding wall thereof has a generally cylindrical shape, and said track is generally spiral.

7. A solid fuel burning furnace according to claim 6, wherein said bowl includes a conic member disposed at the center of said bed to urge fuel outward toward said combustion chamber means.

8. A solid fuel burning furnace according to claim 7, wherein said conic member has a hollow portion beneath it extending to an edge of said one portion of the bed, and said air injecting means includes a primary air conduit coupled to said hollow portion so that primary air may be forced beneath said conic member into said combustion chamber means.

9. A solid fuel burning furnace according to claim 6, wherein said drive means includes an electric drive unit disposed centrally on said bowl between the latter and said base.

10. A solid fuel burning furnace according to claim 9, further comprising resilient support members disposed between said bowl and said base, each said member being angularly disposed so that said bowl is torsionally thrusted by cooperation of said electric drive unit and said members.

11. A solid fuel burning furnace according to claim 6, wherein said bed includes screening means disposed away from the bottom of said bowl for supporting embers of the fuel as it burns, but permitting the ash residue thereof to drop through to said bottom.

12. A solid fuel burning furnace according to claim 11, wherein said screening means further extends upward coaxially with and away from said upstanding wall.

13. A solid fuel burning furnace according to claim 11 or claim 12, further comprising supporting means disposed on the portion of said bowl exterior to said fuel chamber means for supporting said screening means and for forming a dam for said ash residue so that a layer of ash is maintained at the bottom of said bowl to protect the latter from excessive heat.

14. A solid fuel burning furnace according to claim 5, wherein said fuel chamber means includes a cleaning access sleeve permitting access from outside said housing to said fuel chamber for inspection and cleaning thereof.

15. A solid fuel burning furnace according to claim 14, further including an access door for closing said access sleeve and interlock switch means associated with said access door permitting said furnace to be energized only if said door is closed.

16. A solid fuel burning furnace according to claim 5, wherein means for introducing fuel includes sensor means for sensing the depth of fresh fuel in said fuel chamber means, and permitting said means for introducing fuel to add new fuel only when such depth is below a predetermined level.

17. A solid fuel burning furnace according to claim 5, further comprising secondary air injecting means disposed in said combustion chamber means above said bed for introducing secondary air into the combusting fuel and primary air above said bed thereby to ensure more complete combustion.

* * * * *